US006062604A

United States Patent [19]

Taylor et al.

[11] Patent Number: 6,062,604

[45] Date of Patent: May 16, 2000

[54] SELF-VERIFYING SECURITY DOCUMENTS

[75] Inventors: John Charles Taylor, Dural; Bruce Alfred Hardwick, Wandong; Wayne Kevin Jackson, Reservoir; Paul Zientek, North Carlton; Cameron Rex Hibbert, Churchill, all of Australia

[73] Assignee: Securency Pty Ltd., Victoria, Australia

[21] Appl. No.: 09/284,171

[22] PCT Filed: Oct. 8, 1997

[86] PCT No.: PCT/AU97/00675

§ 371 Date: Apr. 9, 1999

§ 102(e) Date: Apr. 9, 1999

[87] PCT Pub. No.: WO98/15418

PCT Pub. Date: Apr. 16, 1998

[30] Foreign Application Priority Data

Oct. 10, 1996 [AU] Australia ..... P0 2892

[51] Int. Cl.[7] ..... B42D 15/00

[52] U.S. Cl. ..... 283/72; 283/17; 283/73; 283/107

[58] Field of Search ..... 283/72, 73, 74, 283/91, 93, 94, 98, 99, 107, 109, 17, 901, 65

[56] References Cited

U.S. PATENT DOCUMENTS

| | | | |
|---|---|---|---|
| 3,227,474 | 1/1966 | Hoeflinger | 283/17 X |
| 4,100,689 | 7/1978 | Broune | 283/73 |
| 5,246,375 | 9/1993 | Goede | 283/73 X |
| 5,321,755 | 6/1994 | Vlaar | 283/17 X |
| 5,445,417 | 8/1995 | Bromer et al. | 283/109 X |

FOREIGN PATENT DOCUMENTS

| | | |
|---|---|---|
| 45319/68 | 4/1970 | Australia . |
| 73762/74 | 4/1976 | Australia . |
| 0 388 090 | 9/1990 | European Pat. Off. . |
| 3208204 | 9/1983 | Germany . |
| 2 172 850 | 10/1986 | United Kingdom . |

*Primary Examiner*—Willmon Fridie, Jr.

*Attorney, Agent, or Firm*—Christensen O'Connor Johnson & Kindness PLLC

[57] ABSTRACT

A self-verifying security document, such as a banknote (1) comprises a flexible sheet formed from a plastics substrate (2) bearing indicia (3). The sheet has a window (5) of transparent plastics material which includes self-verification means (11) for verifying a security device (4) provided at a laterally spaced second portion of the sheet when the sheet is bent or folded to bring the window (5) into register with the security device (4). The self-verification means may be an optical lens (11) for reading an area of microprinting (10). In another embodiment, the self-verification means may be an optical filter (21) for viewing an area (22) printed with metameric inks. In other embodiments, the self-verification means and the security device (4) may be polarising windows (31, 32) or Moire inducing patterns (41, 42).

39 Claims, 4 Drawing Sheets

SELF-VERIFYING SECURITY DOCUMENTS

This is a United States national stage application of International application No. PCT/AU97/00675, filed Oct. 8, 1997, the benefit of the filing date of which is hereby claimed under 35 U.S.C. § 120, which in turn claims the benefit of Australian application No. PO 2892, filed Oct. 10, 1996, the benefit of the filing date of which is hereby claimed under 35 U.S.C. § 119.

This invention relates to security documents, such as banknotes or the like, and is particularly concerned with providing a security document which includes means for verifying the security document or another similar document.

A wide variety of security devices or features for security documents, such as banknotes, travellers cheques or the like has been proposed previously. Examples of such security devices and features include: optically variable devices, such as holograms and diffraction gratings; security threads or strips; microprint; fine line or "filigree" patterns; Moire inducing patterns; and fluorescent inks, phosphorescent inks, pearlescent inks or other optically variable inks, such as metameric inks.

Metamerism has been described as "the property of the eye and brain to receive the same colour sensation (under specific lighting conditions) from two objects with different spectral energy distributions". Metameric inks have the unique property of appearing to change colour when viewed in different lighting conditions. For example, two inks with different metameric properties may appear to be of an identical colour when viewed in a particular white light environment, say daylight, but when viewed in different lighting conditions, e.g. in incandescent light, or in filtered light, the two inks will appear to have different reflective colours, so that one ink is distinguishable from the other. The optical effect of inks with metameric properties is widely accepted as a security device which inhibits such counterfeiting attempts as computer scanning and colour photocopying. Colour photocopying and colour printing is typically restricted to four different pigments (black, cyan, yellow and magenta) when attempting to match the colour of the original. In the event of reproducing metamerism, the colour distinction of an image with a different colour appearance in a particular lighting environment, is not as evident in the copy when compared to the original. The use of metameric inks as an anti-counterfeiting feature or security device in security documents is also described in U.K. Patent No. GB 1407065.

One disadvantage of metameric inks as a security device is that they require an optical filter or other external aid, to provide the required lighting condition for verification of the security device. Other types of security devices also require external aids for their verification. For example, fluorescent inks may require a source of ultraviolet light for their verification, and microprint, fine line and filigree patterns may require a magnifying lens for verification. Also, Moire inducing patterns, which produce fringes or a Moire effect when there is interference with a superimposed similar pattern, have hitherto only been effective as an anti-counterfeiting device when an attempt is made to reproduce a security document by colour photocopying. Also, a separate viewing device is required to verify that a security document has a Moire inducing pattern.

In Australian Patent Specification No. AU-A-87665/82 there is disclosed a security document and a method of producing a security document, in which opacifying coatings of ink are applied to both sides of a sheet-like substrate formed from a clear plastics film. The security document may be produced with some areas to which no opacifying coating is applied on both sides of the clear plastics substrate. These clear, transparent areas are known as "windows" and are particularly suitable for incorporating security devices, for example diffraction gratings, optically variable devices and embossed images, which can be inspected in the transparent areas or windows from both sides of the security document.

The present invention proposes that a transparent window in a security document may be used as a means for verifying, enhancing or optically varying a security device elsewhere on the document or on another security document.

According to one aspect of the invention, there is provided a security document such as a banknote, comprising a single flexible sheet formed from a substrate bearing indicia, said sheet having a first portion of transparent plastics material, and a security device provided at a second portion of the sheet spaced laterally from the transparent first portion, wherein the transparent first portion includes self-verification means to verify or inspect the security device when the sheet is bent, folded or twisted to bring the first and second portions into register with one another.

In addition to verifying or inspecting a security device at a laterally spaced location on the same security document, the self-verifying means may also be used to verify or inspect a security device on another security document.

The security document is preferably formed from a sheet-like substrate of transparent plastics material to which at least one opacifying layer or coating is applied on one side or both sides of the substrate except in the area or areas where it is desired to provide a transparent, essentially indicia-free portion or "window" in the security document. The at least one opacifying layer therefore only partially covers the surface of the substrate to leave said first portion essentially indicia-free.

The opacifying layer or at least one of the opacifying layers on either side of the plastics substrate may comprise a paper layer which bears indicia. Alternatively, in a preferred embodiment, the opacifying layer on each side of the sheet comprises at least one coating of opacifying ink applied to each surface of a transparent plastics substrate. It is also conceivable that a security document in accordance with the invention could be formed almost entirely from an opaque paper or laminated substrate construction except for an area or areas formed from a transparent plastics material to provide a window or windows.

The security document may take any desired shape, but in the case of a banknote, cheque or the like the flexible sheet is preferably rectangular. In the case of a square or oblong rectangular sheet the first and second portions may be so disposed that folding of the sheet about a center line brings the first and second portions into register. For an oblong sheet having a major axis and a minor axis, the first and second portions may be so disposed that folding of the sheet about a line coincident with or parallel to either the major axis or the minor axis brings the first and second portions into register. Alternatively, the sheet may be folded about a line inclined to the major and minor axes, such as a diagonal line in a rectangular sheet, to bring the first and second portions into register.

Instead of folding the sheet, the flexible sheet may be bent or folded to form a cylinder to bring the first and second portions into register so that the security device in the second portion may be inspected or verified by viewing the security device through the self verification means in the first portion.

In one embodiment of the invention, the self-verification means comprises an optical lens provided in the transparent first portion or window and the security device provided at the second portion comprises a printed or embossed feature which can be inspected, enhanced or optically varied by viewing through the optical lens of the security document or through an optical lens of another, similar security document.

One type of optical lens which may be provided in the window of a security document in the present invention is a Fresnel magnifying lens of the type used in overhead projectors. Such a magnifying lens may be formed by embossing, engraving or otherwise deforming the transparent, indicia-free plastics portion with concentric circular lines. A magnifying lens may alternatively be produced by applying an ultraviolet (UV) or otherwise curable varnish or coating which is printed with the required structure which is then made permanent by the curing process. A magnifying lens provided in the window of a flexible security document may be used to enlarge microprinting, a small image or a fine line or filigree pattern on another part of the security document or on another, similar security document. As an alternative to the Fresnel magnifying lens, a multiple micro-lens array or a lenticular lens array may be used.

The self-verification means may comprise another form of optical lens, such as a distorting lens. A distorting lens may be used to distort a security device, feature or image on another part of the security document, or to correct a distorted feature or image on another part of the security document.

In another embodiment of the first aspect of the invention, the security device comprises an area printed with metameric inks and the self-verification means comprises an optical filter for viewing the area printed with metameric inks. The optical filter is preferably arranged to restrict the wavelength distribution of the light that is incident on, and/or reflected from the area printed with metameric inks. This may be achieved by providing a colour tinted optical filter in the transparent, essentially indicia-free portion. A colour tinted transparent window creates a restricted or altered wavelength environment so as to reveal the colour changing properties of an image printed in metameric inks enabling the authentication of the banknote to be verified.

In accordance with a second aspect of the invention, there is provided a security document comprising a flexible sheet formed from a substrate bearing indicia, said sheet having an essentially indicia-free portion of transparent plastics material, wherein the transparent, essentially indicia-free portion includes a colour tinted optical filter for viewing an area printed with metameric inks on the same or a different security document.

The optical filter in the transparent window may be produced by various processes. One process for producing a colour tinted optical filter is to include appropriate pigments with a polymer in the production of a plastics film substrate to achieve an overall tint of the plastics film. In an alternative process a tinted varnish may be applied over a transparent plastics window by a gravure or offset process.

In accordance with a third aspect of the invention, there is provided a security document comprising a flexible sheet formed from a substrate bearing indicia, said substrate having an essentially indicia-free window of transparent plastics material including self-verifying means having polarisation characteristics for verifying a security device in the form of a second transparent polarising window at another location on the same or a different security document.

Polarisation is an optical effect widely used in items such as polarised sunglasses. Light waves from a luminous source vibrate not only in the vertical and horizontal planes but all others in between. Polarisation is an effect whereby the light is confined to one direction only. In the event of the plane polarised light passing through a secondary polarising medium whose polarisation axis is at right angles to the first, then near zero intensity of the light results.

This phenomenon is utilised, in the present invention, by using the transparent windows of security documents such as polymer banknotes. By superimposing a clear window over a second window, both with plane polarisation characteristics, the polarisation property including light extinction will be observed. The second polarising window may be present on the same security document or may be present on a different security document. In each case, the polarisation effect is achieved from the combination of the transparent polarising windows.

When two transparent polarising windows are located at different locations on a single flexible security document, the first and second polarising windows are preferably constructed and arranged in such a manner that, when the flexible security document is folded over itself to bring the polarising windows into register, the second polarising window has a polarisation axis extending at an angle to the polarisation axis of the first polarising window so that the intensity of light transmitted through the windows is reduced. If the polarisation axes of the first and second polarising windows are substantially perpendicular to one another in the folded security document, the intensity of light transmitted through the windows will be nearly zero.

A banknote with polarising windows may be formed by various methods. In one possible method, a transparent plastics substrate or film may be stretched in one direction during manufacture. In other methods, liquid crystals may be incorporated in a transparent polymeric film which may form the substrate or be added as a coating to the substrate.

In another embodiment of the invention the self-verification means comprises a feature including a first set of lines and the security device comprises a feature including a second set of lines, wherein an interference effect is produced when the security document is bent or folded to bring the self-verifying means and the security device into register. Preferably, the self-verifying means and the security device are Moire inducing patterns.

In accordance with a fourth aspect of the invention, there is provided a security document comprising a flexible sheet formed from a substrate bearing indicia, said sheet having a first portion of transparent plastics material including self-verifying means in the form of a Moire inducing pattern for verifying a security device in the form of another Moire inducing pattern at another location on the same or a different security document.

Moire inducing patterns consist of sets of threads or fine lines which produce optically variable effects when a first Moire inducing pattern is superimposed on a second Moire inducing pattern in which the threads or fine lines are inclined at an angle to the threads or fine lines of the first Moire inducing pattern. The transmission of light through superimposed or overlaying sets of inclined lines produces the appearance of dark bands known as "Talbot fringes" which may form an image.

The use of Moire inducing patterns has been previously proposed in security documents as a security device or anti-counterfeiting feature to deter counterfeiting by photocopying. However, in such documents, the Moire effect or fringes are only apparent on the counterfeit photocopied image of a security document which includes a Moire inducing pattern. In the present invention, a Moire inducing pattern is incorporated into the transparent plastics window of a security document as a self-verifying security device which, together with another Moire inducing pattern provided at another location in the same security document or in another security document, produces a Moire effect which is readily identifiable to verify the document.

When first and second Moire inducing patterns are provided at two different transversely spaced locations in a single flexible security document, the first and second Moire inducing patterns are preferably arranged in such a manner that, when the flexible security document is folded over itself to bring the Moire inducing patterns into register, the set of lines of the second Moire inducing pattern are inclined to the set of lines of the first Moire inducing pattern.

The set of lines provided in a transparent window to form a Moire inducing pattern may be formed by any convenient printing, embossing or engraving process.

According to a further aspect of the invention, there is provided a method of verifying a security document in accordance with any of the preceding aspects of the invention, wherein the method comprises the step of bending, folding or twisting the flexible sheet to bring the first portion including the self-verifying means into register with the security device provided at the second portion of the sheet.

Various embodiments of the present invention will now be described, by way of example only, with reference to the accompanying drawings in which.

Figure 1:
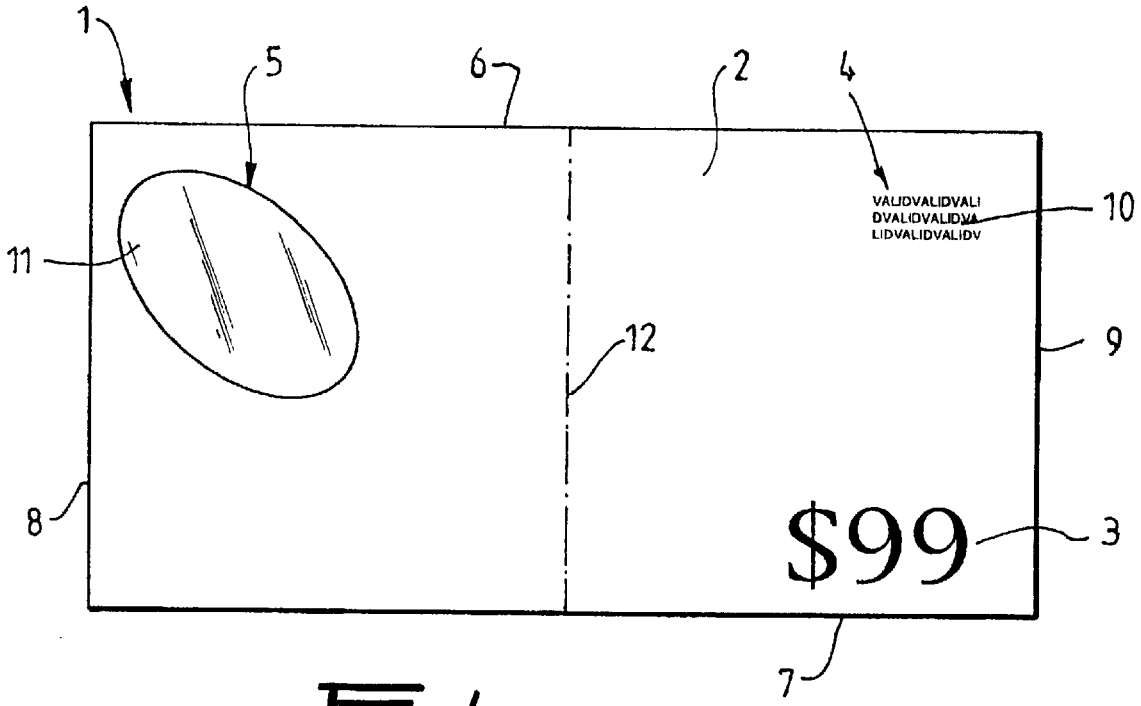
FIG. 1 is a plan view of a banknote in accordance with a first embodiment of the invention.
Figure 2:
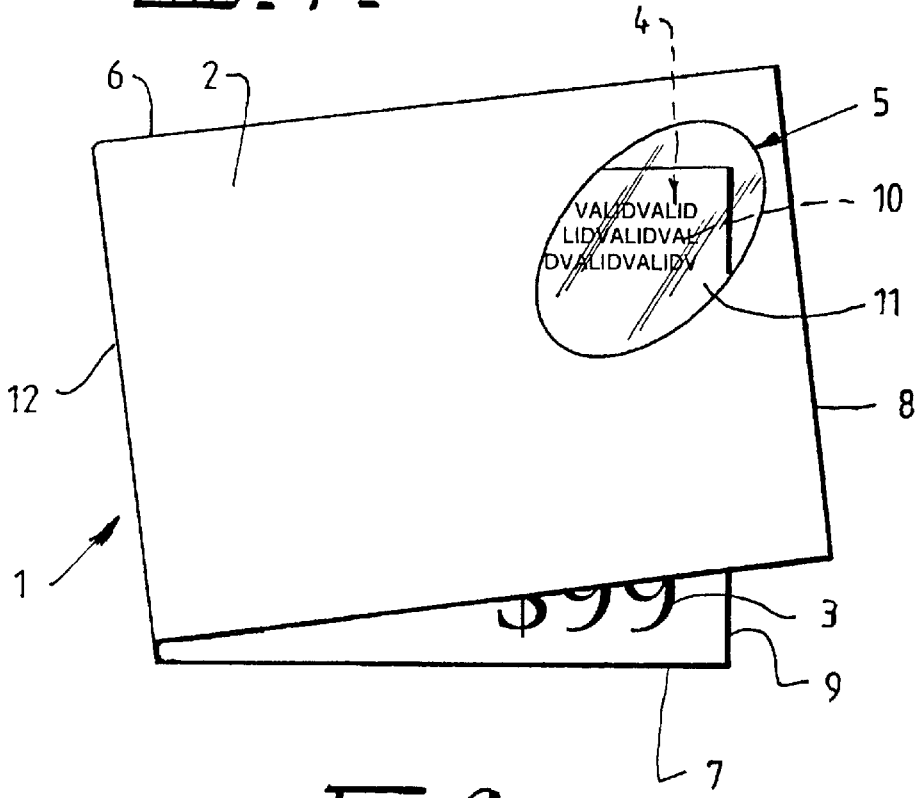
FIG. 2 is a view of the banknote of FIG. 1 folded over itself.

The banknote 1 shown in FIGS. 1 and 2 is substantially rectangular in shape having substantially parallel sides 6 and 7 and substantially parallel ends 8 and 9 and comprises a flexible, sheet-like substrate 2 of transparent plastics material bearing indicia 3. The substrate 2 is covered over most of its upper and lower surfaces by opacifying layers. As used herein, the term indicia includes coloured areas, patterns, pictures, shapes, sets of lines, letters, numerals and symbols. For the sake of convenience, the value "$99" is the only indicia 3 shown in FIGS. 1 and 2 apart from a security device 4 which comprises an area of microprinting 10 consisting of the word "VALID" repeated several times. Although the word "VALID" is apparent in FIG. 1, the microprinting may be of a size wherein it is not apparent or only barely distinguishable to the naked eye.

As shown in FIG. 1, the opacifying layers of indicia are not applied over the entire surfaces of the sheet-like substrate 2 and thus leave a transparent portion 5 of the substrate which is at least partially not covered by the opacifying layers.

This transparent, essentially indicia-free portion 5 constitutes a "window" in the banknote through which light may be transmitted.

The substrate 2 of transparent plastics material preferably is formed from a transparent polymeric material which may be made up of at least one bi-axially-oriented polymeric film. The substrate may comprise a single layer film of polymeric material. Alternatively, the substrate may comprise a laminate of two or more layers of transparent bi-axially-oriented polymeric film of the type described in Australian Patent No. AU-A-87665/82, the contents of which are incorporated herein by reference.

The opacifying layers of indicia 3 may comprise any one or more of a variety of opacifying inks which can be used in the printing of banknotes or other security documents. For example, the layers of opacifying ink may comprise pigmented coatings comprising a pigment, such as titanium dioxide, dispersed within a binder or carrier of heat-activated cross-linkable polymeric material as described in Australian Patent Specification No. AU-A-87665/82. Alternatively, a substrate of transparent plastics material 2 may be sandwiched between opacifying layers of paper to which indicia is printed or otherwise applied.

The transparent, essentially indicia-free portion or window 5 is located towards a corner at one end 8 of the rectangular banknote, and the security device 4 is located towards a corner on the same side 6 and at the opposite end 9 of the banknote.

In the embodiment of FIGS. 1 and 2, the transparent, essentially indicia-free portion or window 5 includes self-verifying means in the form of an optical magnifying lens 11. Thus, when the flexible banknote 1 is folded upon itself generally about a centre line 12 extending transversely across the note as shown in FIG. 2, the magnifying lens 11 may be used to view the area of microprinting 10 constituting the security device 4 which appears as an enlarged image. Thus, the security document 1 is self-validating in that one part of the banknote, the magnifying lens 11 in the window 5, may be used to inspect and verify a security device 4, the area of microprinting 10, provided at another part of the banknote 1.

It will also be appreciated that a banknote or other security document provided with a magnifying lens 11 in a window 5 may also be used to inspect, enlarge and verify microprinting, small images or other security devices on another banknote or security document.

The magnifying lens may comprise a Fresnel magnifying lens which may be formed by embossing, engraving or otherwise deforming the transparent window 5 to produce a series of concentric circular lines.

The Fresnel lens may be formed in a printing process by an embossing technique. To achieve the required optical refraction it may be necessary to emboss primarily on one side of the film only. If the embossing process embosses both sides of the substrate equally, a coating can be used to fill in one of the embossed surfaces to produce the desired optical lens. The intaglio process is commonly used for embossing, and for a distinctive ink transfer onto banknotes and other security documents. The Fresnel engraving design can be embossed into the window under high pressure and temperature in the intaglio process.

Alternatively, a Fresnel magnifying lens can be embossed on the window 5 using a hot stamping technique, more commonly used to transfer optically variable devices (OVDs) onto banknotes. A magnifying lens may also be produced by applying an ultraviolet (UV) or other energy curable varnish or coating which is printed or embossed with the required structure and then made permanent by the curing process.

Figure 3:
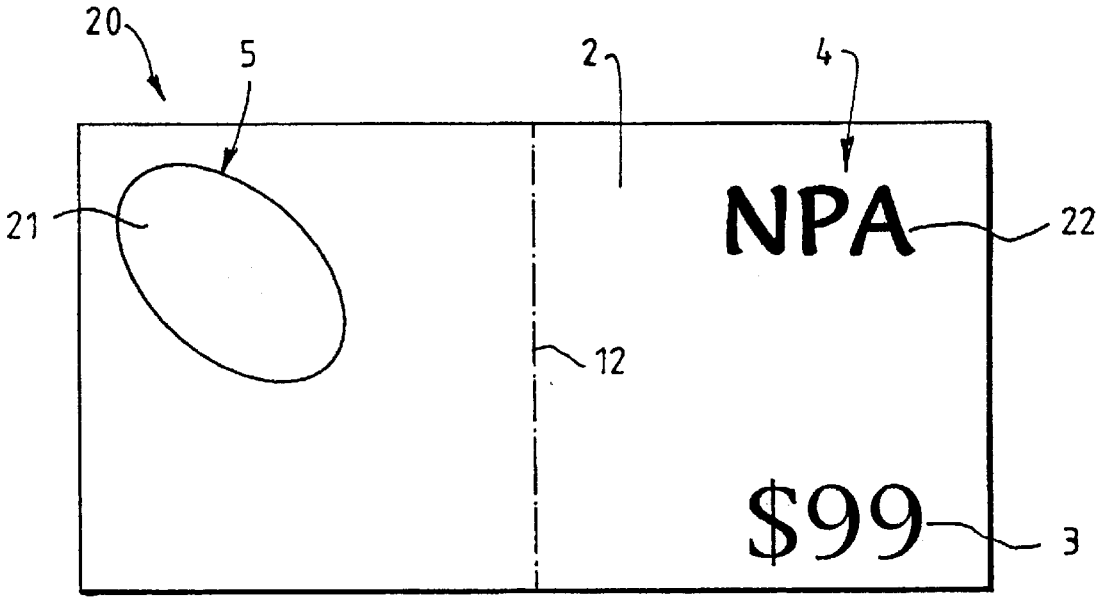
FIG. 3 is a plan view of a banknote in accordance with a second embodiment of the invention.
Figure 4:
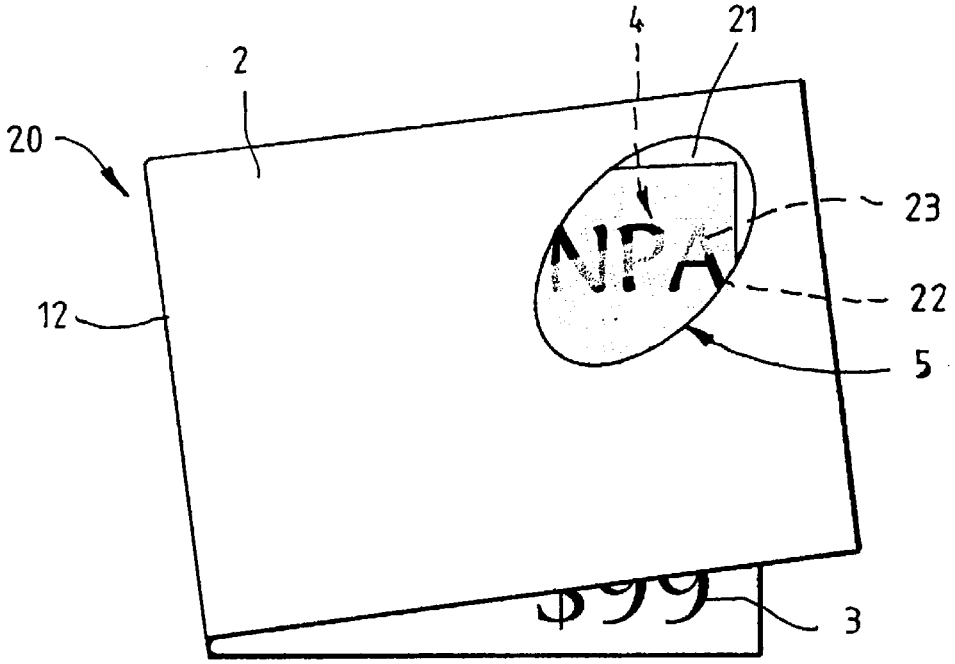
FIG. 4 is a view of the banknote of FIG. 3 folded over itself.

Referring to FIGS. 3 and 4, there is shown a second embodiment of a banknote in accordance with the invention. The banknote 20 is similar to the banknote 1 of FIGS. 1 and 2 and corresponding reference numerals have been applied to corresponding parts. The banknote 20 is therefore substantially rectangular in shape and comprises a flexible, sheet-like substrate 2 bearing indicia 3. The banknote 20 differs from the banknote 1 in that the security device 4 comprises an area including a metameric image 22 printed with metameric inks, and the transparent, essentially indicia-free portion or "window" 5 of the substrate 2 includes a self-verifying means comprising a colour tinted window or "metameric filter" 21.

The security device 4 includes the letters "NPA" which constitute the metameric image 22 formed by printing different parts of the letters with different metameric inks. As shown in FIG. 3, the letters NPA forming the metameric image 22 appear to be exactly the same colour to the naked eye in white light. However, when the banknote 20 is folded over itself about foldline 12, a diagonal band 23 extending across the letters 22 and printed with a different metameric ink from the remainder of the letters appears to be a different colour, or at least a different shade of the same colour, when viewed through the metameric filter 21 as shown in FIG. 4.

The security device 4 printed with metameric inks may be printed by standard printing techniques. The optical or metameric filter 21 in the transparent window 5 may be provided by including an appropriate pigment or pigments in the production of the polymeric substrate 2 so that the transparent, essentially indicia-free window 5 in the printed banknote is colour-tinted. Alternatively, a tinted varnish may be applied over a clear, transparent and essentially indicia-free plastics window by a gravure or offset printing process.

In the embodiment of FIGS. 3 and 4, the use of the transparent plastics window 5 to include an optical or metameric filter 21 which may be used to reveal the colour changing properties of the metameric image 22 on the banknote provides a self-verifying banknote which does not require an external secondary device such as a filter or different lighting source for examining the metameric image to authenticate the banknote.

It will also be appreciated that a banknote including an optical or metameric filter in a transparent window, such as the note of FIG. 3, may also be used to examine and verify another banknote which includes metameric printing or a metameric image as a security device.

Figure 5:
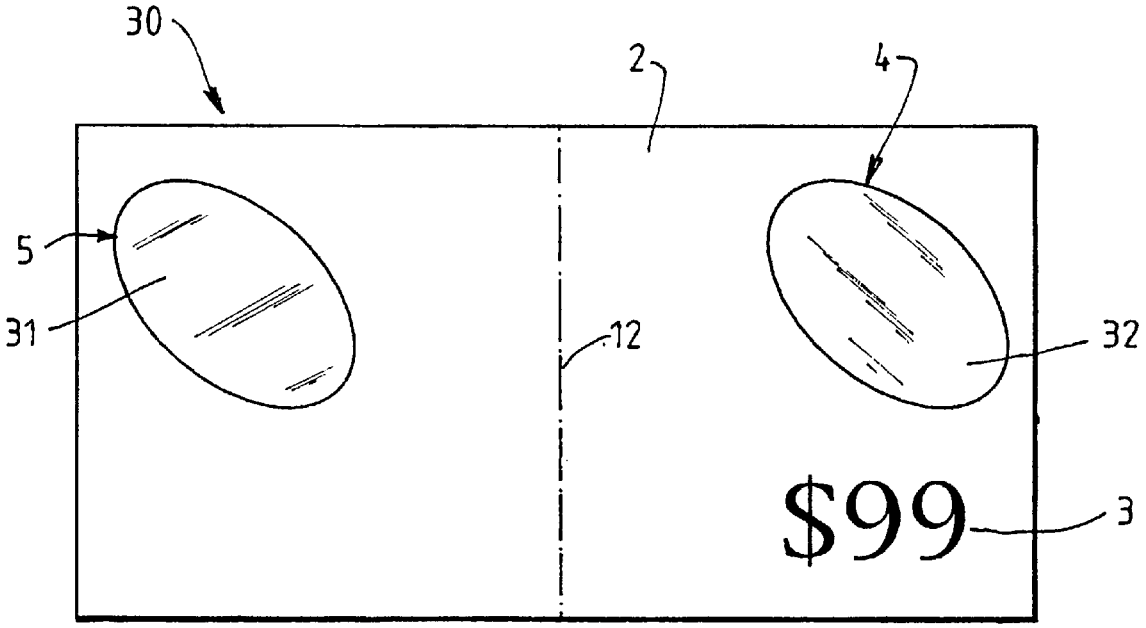
FIG. 5 is a plan view of a banknote in accordance with a third embodiment of the invention.
Figure 6:
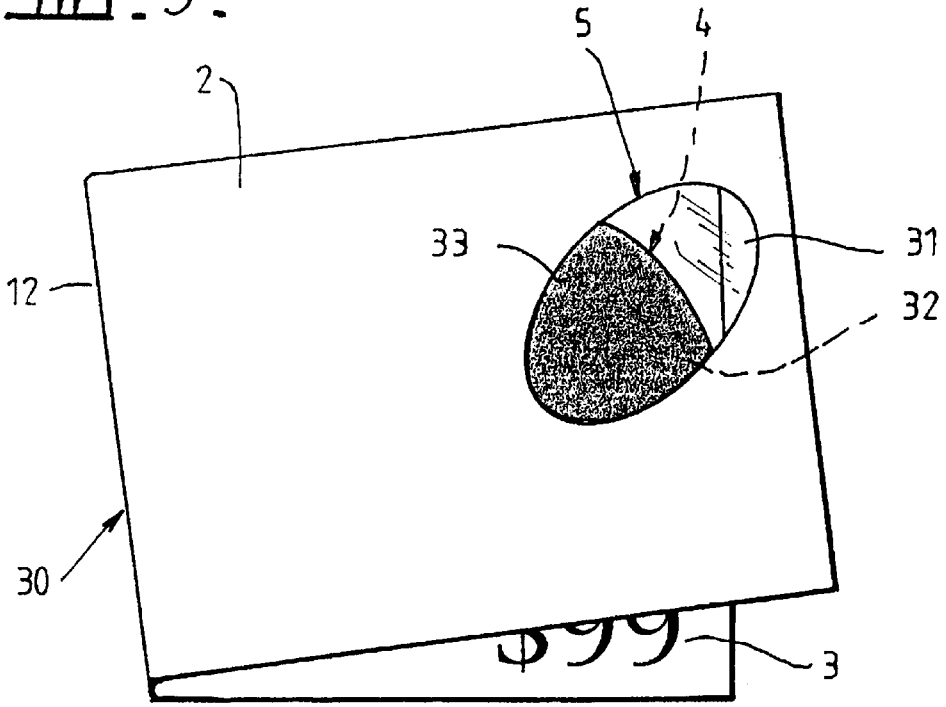
FIG. 6 is a view of the banknote of FIG. 5 folded over itself.

A third embodiment of the invention shown in FIGS. 5 and 6 comprises a banknote 30 which is generally similar to the banknote 1 of FIGS. 1 and 2 and again corresponding reference numerals have been applied to corresponding parts. The banknote 30 differs from the banknote 1 in that the transparent, essentially indicia-free portion or window 5 of the substrate 2 includes self-verifying means in the form of a first polarising window 31, and the security device 4 comprises another transparent, essentially indicia-free portion in the form of a second polarising window 32.

The first polarising window 31 has a first plane polarisation axis, e.g. parallel to the longitudinal axis of the banknote 30, and the second polarising window 32 is preferably arranged to have a second plane polarisation axis extending substantially perpendicularly to the first polarisation axis of the first polarising window 31, e.g. extending transversely to the longitudinal axis of the banknote. Thus, when the banknote 30 is folded over itself about the fold line 12 to bring the first and second polarising windows 31 and 32 into register, the intensity of light transmitted through both of the polarising windows 31 and 32 is substantially zero as depicted by the dark shaded region 33 in FIG. 6.

It will, however, be appreciated that the orientations of the first and second plane polarisation axes may vary. For instance, if the first polarising window 31 shown in FIG. 5 has a diagonal first plane polarisation axis extending along the major axis of the elliptically shaped window 31, the second polarising window 32 may have a second polarising axis extending substantially parallel to the first polarising axis in the unfolded note shown in FIG. 5, but when the note is folded as shown in FIG. 6, the first and second polarisation axes are substantially perpendicular. It is also conceivable that different parts of the polarising windows 31 and 32 may have different polarisation axes so that more interesting optical patterns or effects may be created when the polarising windows are brought into register.

Thus, in the embodiment of FIGS. 5 and 6, the first and second polarising windows 31 and 32 together form a self-verifying security device which does not require an external optical device or apparatus to verify the authenticity of the security device. Whilst a banknote incorporating a first polarising window may be used to verify another polarising window at another part of the banknote, it may also be used to verify a polarising window on another similar banknote.

Transparent polarising windows may be produced by different methods. In one possible method, a base film of transparent plastics material may be stretched in one direction during manufacture to produce a differential alignment or orientation of crystals or molecules in the plastics film. In another method, a polymer dispersed liquid crystal (PDLC) film may be used to form a transparent, essentially indicia-free portion or polarising window. A PDLC film is generally characterised by a thin, typically from 10 to 25 micron, film of polymeric material which contains approximately micron sized droplets of a nematic liquid crystal.

Such films may be produced by emulsifying a polymer, water and a liquid crystal mixture, to produce a so-called nematic curvilinear aligned phase (NCAP) film. Other methods of producing PDLC films include polymerising a homogeneous solution of liquid crystal and prepolymer. As the resultant polymer forms it causes the liquid crystal to "phase separate", ideally in the form of discrete droplets. This technique is usually referred to as "polymerisation induced phase separation" (PIPS) and gives rise to PDLC films. Polymerisation may be caused by heat (e.g. on an epoxy resin or other curing agent) or by ultraviolet (UV) light (e.g. using an acrylate or thiol-ene system). A PDLC film may either be used as a transparent substrate to which opacifying layers of indicia are applied to form a banknote, or a PDLC film may be applied as a coating to a transparent, essentially indicia-free portion of the note to form a polarising window.

Figure 7:
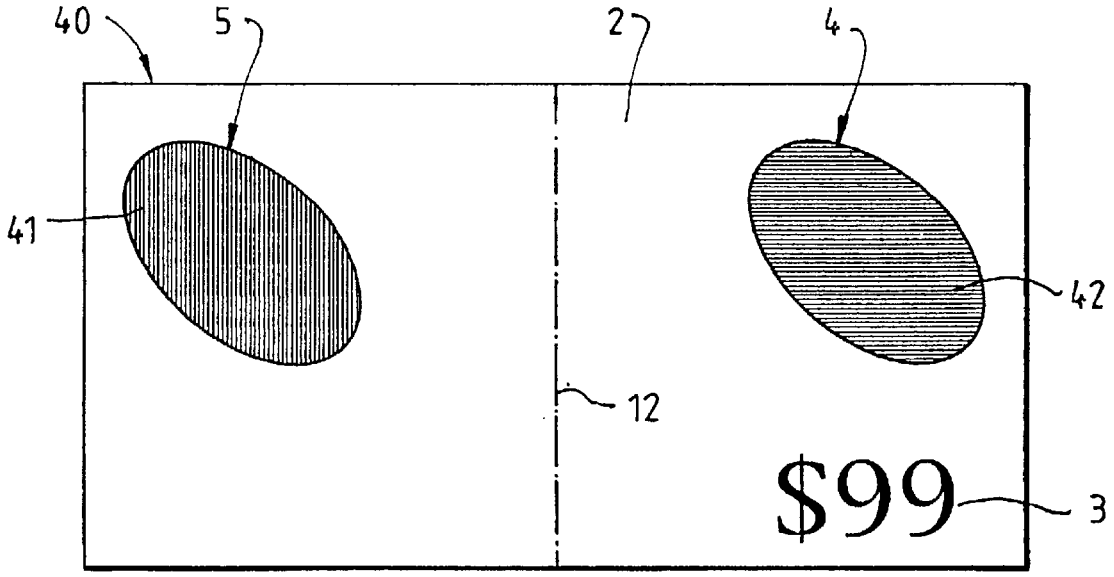
FIG. 7 is a plan view of a banknote in accordance with a fourth embodiment of the invention.
Figure 8:
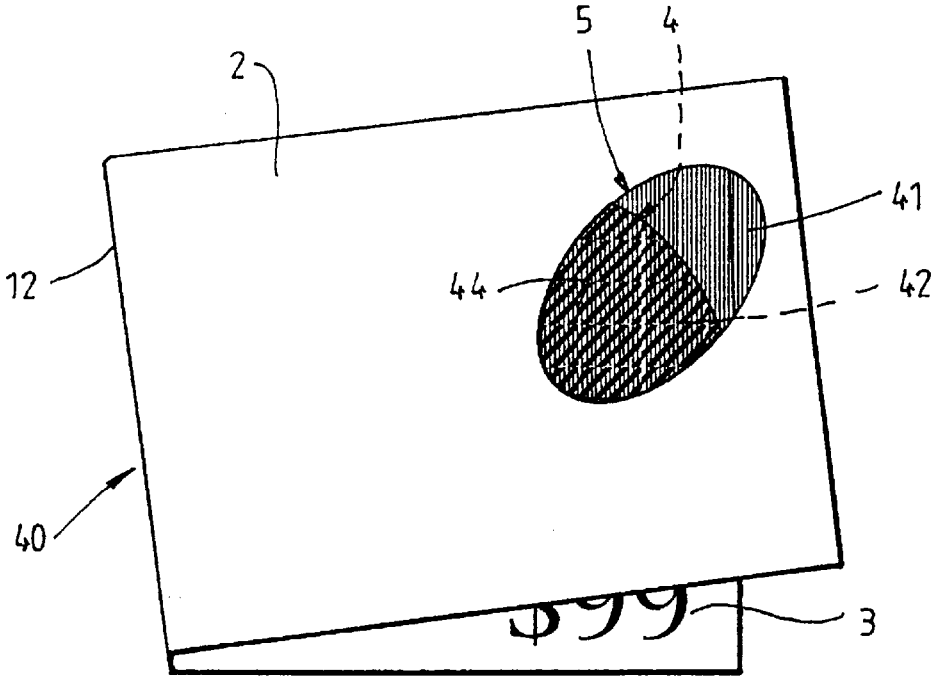
FIG. 8 is a view of the banknote of FIG. 7 folded over itself.

Referring to FIGS. 7 and 8, there is shown a fourth embodiment of a banknote 40 in accordance with the invention. The banknote 40 is similar to the banknote 30 of FIGS. 5 and 6 and corresponding reference numerals have been applied to corresponding parts. The banknote 40 differs from the banknote 30 in that instead of polarising windows, the first transparent, essentially indicia-free portion or window 5 includes self-verifying means in the form of a first Moire inducing pattern 41 consisting of a set of closely spaced, fine lines, and that the second transparent essentially indicia-free portion or window 4 includes a security device in the form of a second Moire inducing pattern 42 also consisting of a set of closely spaced, fine lines.

As shown in FIG. 7, the fine lines of the first Moire inducing pattern 41 extend substantially parallel to each other in a transverse direction across the banknote 40, and the fine lines of the second Moire inducing pattern extend substantially parallel to each other in the direction of the longitudinal axis of the banknote 42. Thus, when the banknote 40 is folded over itself about the foldline 12 to bring the first and second windows 4 and 5 into register and the superimposed Moire inducing patterns 41 and 42 are viewed in transmitted light, a series of dark bands known as Talbot fringes 44 are produced which, in the folded banknote shown in FIG. 8 extend diagonally. The fringes 44 may render the first and second Moire inducing patterns 41 and 42 largely indistinguishable. Alternatively, the fringes may enhance the Moire inducing patterns, creating a dynamic optical effect when the patterns are overlapped.

It will, however, be appreciated that the orientations of the set of lines of the first and second Moire inducing patterns 41 and 42 may vary. For instance, if the sets of lines in each Moire inducing pattern 41, 42 in FIG. 7 were to extend diagonally parallel to the major axes of the elliptically shaped windows 4 and 5, then in the folded banknote 40 shown in FIG. 8 the sets of lines in the first and second Moire inducing patterns 41 and 42 would be substantially perpendicular and a similar pattern of Talbot fringes would be produced.

It is also possible that different parts of each Moire inducing pattern 41, 42 may have different sets of lines extending in different directions so that more interesting Moire effects, possibly with Talbot fringes forming predetermined shapes or images, may be produced when the windows 4 and 5 are brought into register in the folded banknote.

The sets of lines forming the Moire inducing patterns 41 and 42 in the transparent windows 5 and 4 may be formed by embossing or printing the lines on the transparent, indicia-free portions of the substrate 2, for instance in an intaglio printing process or in a gravure or offset printing process.

In the embodiment of FIGS. 7 and 8, the first and second Moire inducing patterns 41 and 42 in the transparent windows 5 and 4 together constitute a self-verifying security device which does not require an external optical device or apparatus for verification. Further, while a banknote incorporating a first Moire inducing pattern in a transparent window may be used to verify another Moire inducing pattern in a transparent window in another part of the same banknote, it may also be used to verify a Moire inducing pattern provided in a transparent window in another, similar banknote.

At least some of the embodiments of the invention, particularly the third and fourth embodiments and also the first embodiment, provide the general ability to verify a security device by viewing it through a window including self-verifying means which may be oriented at different angles in a flexible security document, such as a banknote, for instance by twisting the document to create a dynamic variation in the observed effect, rather than a static effect produced by viewing in only one orientation. For example, the amount of light transmitted by polarising windows may vary as a document is twisted or rotated. Where the self-verifying means is an optical lens, twisting of a security document may cause a distortion in an image forming the security device, and in the case of Moire inducing patterns, the Moire effect created by overlapping patterns may shift or experience a frequency change as the two Moire inducing patterns are twisted or rotated relative to one another.

In a further embodiment of the invention (not shown in the drawings), there is provided a flexible banknote or other security document wherein a transparent, essentially indicia free portion or "window" carries self-verifying means comprising a first portion of an image which, together with a security device in the form of a second portion of the image, forms a full image when the flexible banknote or other security document is folded over itself to bring the first and second portions of the image into register. The first portion of the image may be printed or embossed on the window, and the second portion of the image may be provided either on another transparent, essentially indicia-free window or on a part of the substrate covered by an opacifying coating. Preferably, the second portion of the image is hidden in an opacifying coating under reflected light, but is visible in transmitted light with the full image being visible in transmitted light when the note is folded over itself to bring the first and second portions of the image into register.

The embodiments of self-verifying security documents described above have the advantage that they may be formed relatively inexpensively in a one step or two step manufacturing process. The self-verification means and the security devices in many instances can be formed in a single printing and/or embossing step, such as an intaglio printing process. Also, the security documents formed from a flexible substrate of transparent plastics material are robust and durable and are able to withstand many instances of bending, twisting and folding without significant wear.

It will be appreciated that various modifications and alterations may be made to the embodiments of the present invention described above without departing from the scope or spirit of the present invention. For instance, two or more transparent windows including the same or different types of self-verification means may be provided at different locations on a single security document for verifying a plurality of security devices at either locations transversely spaced on the security document.

We claim:

1. A security document, such as a banknote, comprising a single flexible sheet formed from a substrate bearing indicia, said sheet having a first portion of transparent plastics material, and a security device provided at a second portion of the sheet spaced laterally from the transparent first portion, wherein the transparent first portion includes self-verification means to verify or inspect the security device when the sheet is bent, folded or twisted to bring the first and second portions into register with one another.

2. A security document according to claim 1 wherein the sheet is formed from a transparent plastics substrate to which at least one opacifying layer is applied.

3. A security document according to claim 2 wherein said at least one opacifying layer only partially covers the surface of the substrate to leave at least said first portion essentially indicia-free.

4. A security document according to claim 2 wherein the at least one opacifying layer comprises a coating of opacifying ink applied to the transparent plastics substrate.

5. A security document according to claim 1 wherein the flexible sheet is generally rectangular and the first and second portions are so disposed that folding of the sheet about a centre line brings the first and second portions into register.

6. A security document according to claim 1 wherein the sheet is oblong having a major axis and a minor axis and the first and second portions are so disposed that folding of the sheet about a line coincident with or parallel to the major axis or the minor axis brings the first and second portions into register.

7. A security document according to claim 1 wherein the sheet is generally rectangular and the first and second portions are so disposed that folding of the sheet about a diagonal axis brings the first and second portions into register.

8. A security document according to claim 1 wherein the flexible sheet is able to be rolled to form a cylinder and the first and second portions are so disposed that rolling of the flexible sheet into a cylinder brings the first and second portions into register.

9. A security document according to claim 1 wherein the self verification means of the first portion comprises an optical lens and the security device provided at the second portion comprises a feature which can be inspected, enhanced or optically varied by the optical lens when the first and second portions are brought into register.

10. A security document according to claim 9 wherein the optical lens is a magnifying lens.

11. A security document according to claim 10 wherein the security device comprises an area of microprinting, a small image or a fine line or filigree pattern.

12. A security document according to claim 9 wherein the optical lens is a distorting lens.

13. A security document according to claim 12 wherein the security device comprises a feature or image which is distorted by the distorting lens when the first and second portions are brought into register.

14. A security document according to claim 12 wherein the security device comprises a distorted feature or image which is corrected by the distorting lens when the first and second portions are brought into register.

15. A security document according to claim 9 wherein the optical lens is formed by embossing, engraving or otherwise deforming the first portion of transparent plastics material with a series of lines.

16. A security document according to claim 9 wherein the optical lens is formed by applying a curable varnish or coating to the first portion of transparent plastics material.

17. A security document according to claim 1 wherein the security device comprises an area of the sheet printed with metameric inks, and the self-verification means comprises an optical filter for viewing the area printed with metameric inks.

18. A security document comprising a sheet formed from a substrate bearing indicia, said sheet having an essentially indicia-free portion of transparent plastics material, wherein the transparent, essentially indicia-free portion includes a colour tinted optical filter for viewing an area printed with metameric inks on the same or a different security document.

19. A security document according to claim 17 or claim 18 wherein the optical filter is arranged to create a restricted or altered wavelength environment to reveal colour changing properties of the area printed with metameric inks.

20. A security document according to claim 17 or claim 18 wherein the optical filter is produced by including pigments with a polymer in the production of a plastics film substrate to colour tint the substrate.

21. A security document according to claim 17 or claim 18 wherein the optical filter is formed by applying a tinted varnish or coating over the transparent portion.

22. A security document according to claim 1 the self-verification means comprises a first polarising transparent window and the security device comprises a second polarising transparent window.

23. A security document comprising a flexible sheet formed from a substrate bearing indicia, said sheet having an essentially indicia-free window of transparent plastics material with polarisation characteristics for verifying a second transparent polarising window at another location on the same or a different security document.

24. A security document according to claim 22 or claim 23 wherein the first transparent polarising window has a first plane polarisation axis and the second transparent polarising window has a second plane polarisation axis and the windows are disposed so that when the windows are brought into register the intensity of light transmitted through the windows is reduced.

25. A security document according to claim 22 or claim 23 wherein the portion of the sheet including the first polarising window is able to be twisted or rotated relative to the second polarising window to vary the intensity of light transmitted through the polarising windows when they are in register.

26. A security document according to claim 22 or claim 23 wherein each polarising window is formed by stretching the transparent plastics substrate in one direction during manufacture.

27. A security document according to claim 22 or claim 23 wherein the transparent plastics substrate includes liquid crystals to form the polarising window or windows.

28. A security document according to claim 22 or claim 23 wherein a coating containing liquid crystals is applied to at least one transparent, essentially indicia-free portion of the sheet to form a polarising window.

29. A security document according to claim 1 wherein the self-verifying means comprises a feature including a first set of lines and the security device comprises a feature including a second set of lines, wherein an interference effect is produced when the security document is bent or folded o bring the self-verifying means and the security device into register.

30. A security document according to claim 29 wherein the self-verifying means and the security device are Moire inducing patterns.

31. A security document according to claim 29 or claim 30 wherein the self-verifying means and the security device are arranged at transversely spaced locations of the sheet such that when the sheet is folded over itself to bring the self-verifying means and the security device into register, the second set of lines is inclined to the first set of lines.

32. A security document according to claim 29 wherein the first and second sets of lines are printed on the first and second portions of the sheet.

33. A security document according to claim 29 wherein the first and second sets of lines are embossed or engraved on the first and second portions of the sheet.

34. A security document according to claim 1 wherein the self-verifying means comprises a first part of an image and the security device comprises a second part of an image, said first and second parts together forming a complete image when the flexible sheet is bent, folded or twisted over itself to bring the first and second portions into register.

35. A security document according to claim 34 wherein the second part of the mage is provided on a transparent window.

36. A security document according to claim 34 wherein the second part of the image is hidden by an opacifying coating in reflected light but visible in transmitted light.

37. A security document according to claim 34 wherein the first and second parts of the image are printed on the first and second portions of the sheet.

38. A security document according to claim 34 wherein the first and second parts of the image are embossed or engraved on the first and second portions of the sheet.

39. A method of verifying a security document in accordance with claim 1, wherein the method comprises the step of bending, folding or twisting the flexible sheet to bring the first portion of the sheet including the self-verifying means into register with the security device provided at the second portion of the sheet.

* * * * *

UNITED STATES PATENT AND TRADEMARK OFFICE

CERTIFICATE OF CORRECTION

PATENT NO. : 6,062,604
DATED : May 16, 2000
INVENTOR(S) : J.C. Taylor et al.

It is certified that error appears in the above-identified patent and that said Letters Patent is hereby corrected as shown below:

Column 11,
Line 14, after "claim 1" insert -- wherein --

Column 12,
Line 5, "o" should read -- to --
Line 28, "mage" should read -- image --

Signed and Sealed this

Twenty-fifth Day of December, 2001

*Attest:*

*Attesting Officer*

JAMES E. ROGAN
*Director of the United States Patent and Trademark Office*